US009820518B2

(12) United States Patent
Daniels

(10) Patent No.: US 9,820,518 B2
(45) Date of Patent: Nov. 21, 2017

(54) GLOVE GAME AND METHOD OF USE

(71) Applicant: Adam Daniels, Solana Beach, CA (US)

(72) Inventor: Adam Daniels, Solana Beach, CA (US)

( * ) Notice: Subject to any disclaimer, the term of this patent is extended or adjusted under 35 U.S.C. 154(b) by 0 days.

(21) Appl. No.: 14/869,497

(22) Filed: Sep. 29, 2015

(65) Prior Publication Data

US 2017/0086520 A1 Mar. 30, 2017

(51) Int. Cl.

| | |
|---|---|
| ***A41D 19/01*** | (2006.01) |
| ***A63H 3/12*** | (2006.01) |
| ***A63H 3/14*** | (2006.01) |
| ***A63H 3/16*** | (2006.01) |

(52) U.S. Cl.

CPC ..... *A41D 19/01* (2013.01); *A63H 3/12* (2013.01); *A63H 3/14* (2013.01); *A63H 3/16* (2013.01)

(58) Field of Classification Search

CPC ..... A41D 19/0051; A41D 19/01; A41D 19/0048; A41D 19/0082

USPC ..... 2/161.1, 158–159

See application file for complete search history.

(56) References Cited

U.S. PATENT DOCUMENTS

| | | | | | |
|---|---|---|---|---|---|
| D61,481 | S | * | 9/1922 | Rice | D2/616 |
| D61,482 | S | * | 9/1922 | Rice | D2/616 |
| 1,630,730 | A | * | 5/1927 | Daugherty | G08B 5/02 116/35 R |
| 2,546,209 | A | * | 3/1951 | Baum | A63H 3/003 446/327 |
| D168,944 | S | * | 3/1953 | Levene | D2/616 |
| D177,692 | S | * | 5/1956 | O'Brien | D2/616 |
| D179,965 | S | * | 4/1957 | Dannenberg | D2/615 |
| D189,637 | S | * | 1/1961 | Stanton | D2/616 |
| 3,258,858 | A | * | 7/1966 | Cariffe, Jr. | A41D 19/00 2/158 |
| 4,832,606 | A | * | 5/1989 | Clark | G09B 19/0076 36/1 |
| 5,022,093 | A | * | 6/1991 | Hall | A63H 3/14 2/158 |
| 5,117,507 | A | * | 6/1992 | Long | A41D 1/04 2/125 |

(Continued)

OTHER PUBLICATIONS

Jen Arnall-Cullliford Design, "Jen Arnall-Culliford Knitwear", Sep. 1, 2013. http://www.jenacknitwear.co.uk/2013/01/new-year-pattern-sale.html.*

(Continued)

*Primary Examiner* — Shaun R Hurley
*Assistant Examiner* — Bao-Thieu L Nguyen
(74) *Attorney, Agent, or Firm* — Sheppard, Mullin, Richter & Hampton LLP; Daniel Yannuzzi

(57) ABSTRACT

First and second gloves for playing games are provided, as is a method of using the gloves to play games. The gloves include four respective surfaces that each in turn include a partial image. A first and third partial image together form a first full image when the first and second gloves are arranged in a first position. A second and fourth partial image together form a second full image when the first and second gloves are arranged in a second position. The first and third images are on surfaces corresponding to backs of the gloves, while the second and fourth partial images are on surfaces corresponding to fronts of the gloves. The first and second full images may be used to play various games according to embodiments of the present disclosure.

5 Claims, 6 Drawing Sheets

(56) References Cited

U.S. PATENT DOCUMENTS 5,369,257 A * 11/1994 Gibbon ..... A47L 1/16 15/227
5,467,484 A * 11/1995 Drescher ..... A41D 19/01547 2/161.6
5,586,888 A * 12/1996 Webb ..... A43B 3/0078 36/112
5,762,335 A * 6/1998 Magruder ..... A63F 9/08 273/153 R
5,826,595 A * 10/1998 Ramm ..... A45D 20/12 132/200
5,881,384 A * 3/1999 Williams ..... G09F 21/02 2/158
6,142,785 A * 11/2000 Williams ..... G09B 19/02 2/159
6,155,836 A * 12/2000 Hancock ..... G09B 19/02 2/159
6,292,949 B1 * 9/2001 Chang ..... D04B 1/28 15/227
6,405,381 B1 * 6/2002 Bowman, Jr. ..... A41B 7/00 2/123
6,447,464 B1 * 9/2002 Dunlevy ..... A61H 1/0285 2/159
6,886,185 B2 * 5/2005 Wren ..... A41D 19/01558 2/158
D512,752 S * 12/2005 Stainbrook ..... D21/587
7,296,999 B2 * 11/2007 Webber ..... A41D 19/01 434/168
7,310,830 B2 * 12/2007 Kuharcik ..... A41D 27/08 2/115
7,526,814 B2 * 5/2009 Silver ..... A41D 19/01529 2/158
D609,428 S * 2/2010 Bengyak ..... D2/615
D617,976 S * 6/2010 Bengyak ..... D2/615
D618,431 S * 6/2010 Bengyak ..... D2/615
D618,432 S * 6/2010 Bengyak ..... D2/615
D628,357 S * 12/2010 Bengyak ..... D2/617
D628,358 S * 12/2010 Bengyak ..... D2/619
D631,227 S * 1/2011 Bengyak ..... D2/617
D631,637 S * 2/2011 Bengyak ..... D2/617
D632,869 S * 2/2011 Bengyak ..... D2/617
7,895,774 B2 * 3/2011 Pawsey ..... A43B 1/0054 36/112
D636,557 S * 4/2011 Bengyak ..... D2/615
7,942,720 B1 * 5/2011 Galoustian ..... A63H 3/02 446/297
D640,447 S * 6/2011 Bengyak ..... D2/617
D640,857 S * 7/2011 Bengyak ..... D2/619
8,434,164 B2 * 5/2013 Clark ..... A41D 19/0051 2/161.1
D751,642 S * 3/2016 Cohen-Posey ..... D19/59
2002/0020082 A1 * 2/2002 James ..... A43B 3/0078 36/112
2004/0073986 A1 * 4/2004 Cooke ..... A41D 19/0062 2/159
2005/0223600 A1 * 10/2005 Hunter ..... A43B 3/0078 36/112
2007/0204419 A1 * 9/2007 Lewis ..... A41D 19/01594 15/227
2009/0143822 A1 * 6/2009 Perry ..... A41D 19/01 606/235
2009/0193562 A1 * 8/2009 Magglo ..... A63H 3/14 2/158
2010/0175161 A1 * 7/2010 Jarboe ..... A41D 13/085 2/69
2011/0283438 A1 * 11/2011 Davis ..... A63H 3/003 2/158
2011/0289651 A1 * 12/2011 Clark ..... A41D 19/0051 2/161.1
2013/0185842 A1 * 7/2013 Bonner ..... A41D 19/0048 2/158
2013/0219587 A1 * 8/2013 Clark ..... A41D 19/0051 2/161.1

OTHER PUBLICATIONS

WayBackMAchine Internet Archive for Jen Arnall-Cullliford Design, "Jen Arnall-Culliford Knitwear", Sep. 1, 2013. http://www.jenacknitwear.co.uk/2013/01/new-year-pattern-sale.html.*

* cited by examiner

GLOVE GAME AND METHOD OF USE

TECHNICAL FIELD

The present disclosure relates generally to gloves and other garments that may be used to play games, and more particularly to pair of gloves that form various images used to facilitate game playing.

BACKGROUND

Previously, wearable garments have included various images or messages conveyed to those viewing the garment, including for entertainment purposes. By way of example, such garments have included designs such as animal heads and the like, and/or have been designed to simulate the movement of an animal's mouth or head. In addition, the game of peek-a-boo has conventionally been played by covering the face with the hands or another object (e.g., a blanket, towel, napkin, etc.) for a time, and then uncovering the face to surprise a person viewing the same. One issue with the game of peek-a-boo and other games conventionally played using body parts such as hands, arms, the face, and so on, or other objects, is that such games face competition from the ever increasing distraction of portable devices (e.g., tablets and the like) that conveniently provide video games, streaming video, and other entertainment on-the-go; television; and other toys. The increasing popularity of such devices and like distractions from games such as peek-a-boo and other relatively simple and inexpensive forms of entertainment, are affecting even young children that typically have enjoyed playing the game of peek-a-boo and other like games.

SUMMARY

In view of the above issues facing conventional, simple children's games, there is a long-felt need for wearable garments, such as, for example, gloves, having images residing thereon so that the garments can be arranged together to form full or combination images that may be used to play games and otherwise provide entertainment. Further, there exists a long-felt need for such gloves (and other garments) that are particularly configured for playing the game of peek-a-boo. The gloves and other garments disclosed herein provide enhanced entertainment and wholesome fun notwithstanding competition from electronic devices and other sources. Additionally, the disclosed embodiments provide for significantly more variety in the game of peek-a-boo than is available through conventional offerings (e.g., using a towel or blanket).

In one embodiment of the present disclosure, a set of gloves for playing a game of peek-a-boo is provided. The set of gloves includes a first glove and a second glove. The first glove includes a first surface corresponding to a back of a first hand placed in the first glove, and the first surface has a first partial image. The first glove also includes a second surface corresponding to a palm of the first hand, and the second surface has a second partial image. The second glove includes a third surface corresponding to a back of a second hand placed in the second glove, and the third surface has a third partial image. The second glove also includes a fourth surface corresponding to a palm of the second hand, and the fourth surface has a fourth partial image.

The first and third partial images together form a first full image when the first and second gloves are arranged in a first position in front of a wearer's face with the second and fourth surfaces facing toward the wearer's face. In this arrangement, the first full image faces outwardly from the wearer and is viewable from a first location. Furthermore, the second and fourth partial images together form a second full image when the first and second gloves are arranged in a second position with the first and second gloves arranged at opposite sides of the wearer's head near the wearer's ears with the second and fourth surfaces facing in substantially the same direction as the wearer's face. In this arrangement, the second full image is viewable from a second location.

In one example implementation, the first full image includes a first set of features. In another example implementation, the first and third partial images each include respective portions of a common feature of the first set of features, and the common feature extends substantially continuously across the first and second gloves. The second full image may include a second set of features. In one embodiment, each feature of the second set of features is different from the features in the first set of features. The first and second sets of features may be facial features, and may, in some instances, be facial features of an elephant.

According to additional embodiments of the present disclosure, a method of playing a game of peek-a-boo with first and second gloves is provided. The first glove includes a palm-side surface that corresponds to a palm of a first hand, and a back-hand surface that corresponds to a back of the first hand. The second glove includes a palm-side surface that corresponds to a palm of the second hand and a back-hand surface that corresponds to a back of the second hand. The method includes forming a first full image by positioning the first and second gloves in a first position. The first full image includes a first partial image on the back-hand surface of the first glove and a third partial image on the back-hand surface of the second glove. The method also includes substantially covering a wearer's face while the first and second gloves are arranged in the first position. In this arrangement, the first full image faces outwardly from the wearer's face, and the palm-side portions of the first and second gloves are near the wearer's face relative to the back-hand portions of the first and second gloves. Additionally, the method includes forming a second full image by positioning the first and second gloves in a second position. In the second position, the second full image faces outwardly from the wearer's face. The second full image includes a second partial image on the palm-side surface of the first glove, and a fourth partial image on the palm-side surface of the second glove.

In example deployments of the method, forming the second full image includes revealing the wearer's face. In additional examples, the first full image includes a set of primary features, and the second full image includes a set of secondary features not included in the set of primary features. The primary and secondary features may be complementary. The primary and secondary features may be facial features. In various embodiments, at least one of the primary features and secondary features are used to enhance characteristics of the wearer's face.

Additional embodiments of the present disclosure include a pair of gloves for playing a game. The game may be peek-a-boo, by way of example. The pair of gloves includes a first glove with a first portion and a second portion. The first glove includes a first partial image on the first portion of the first glove. The first glove also includes a second partial image on the second portion of the first glove. The pair of gloves also includes a second glove with a third portion and a fourth portion. The second glove includes a third partial image on the third portion of the second glove.

Moreover, the second glove includes a second partial image on the fourth portion of the second glove. The first and third partial images form a first combination image, with the first and second gloves arranged in a first position. Also, the second and fourth partial images form a second combination image, with the first and second gloves arranged in a second position.

In some embodiments, the first and second gloves each include a finger sheath to enclose fingers and a thumb sheath to enclose a thumb. In the first position, the finger sheaths of the first and second gloves are abutted to one another. In the second position, the thumb sheaths reside at least partially between the finger sheaths. In some example deployments, in the first position, the first and second gloves are positioned such that the second portion of the first glove and the fourth portion of the second glove are in front of a wearer's face. In this arrangement, the first combination image is displayed outwardly from the wearer's face toward a recipient viewing the wearer. In these deployments, in the second position, the first and second gloves are spaced apart from one another toward sides of the wearer's head. In this arrangement, the second combination image is displayed toward the recipient. The first combination image may include a first set of features, while the second combination image may include a second set of features. The first and second features may be complementary to one another. In one example implementation, the first set of features includes at least one of a mouth, a noise, and/or eyes; and the second set of features includes ears.

The first glove, in various examples, includes first and second sides that adjoin the first and second surfaces. In such examples, the second glove includes third and fourth sides that adjoin the third and fourth surfaces. In the first position, the first side is in contact with the third side. In the second position, the second and fourth sides are near the wearer's head relative to the first and third sides.

BRIEF DESCRIPTION OF THE DRAWINGS

Further aspects of the present disclosure will be more readily appreciated upon review of the detailed description of the various disclosed embodiments, described below, when taken in conjunction with the accompanying figures.

The figures are described in greater detail in the description and examples below, are provided for purposes of illustration only, and merely depict typical or example embodiments of the disclosure. The figures are not intended to be exhaustive or to limit the disclosure to the precise form disclosed. It should also be understood that the disclosure may be practiced with modification or alteration without departing from the spirit thereof, and that the disclosure may be limited only by the claims and the equivalents thereof.

DETAILED DESCRIPTION

The present disclosure includes various embodiments of a pair of gloves (e.g., fingered gloves or mittens) for playing games, and methods of using the same to play games or to otherwise provide entertainment to both a wearer or user of the gloves and to a recipient interacting with the wearer wearing the gloves. For example, the gloves may be used to present various images to the recipient when the gloves are arranged in different positions (e.g., as shown in FIGS. 3A, 3B, 4A, and 4B). In this manner, the gloves may be used to provide enhanced entertainment beyond conventional garments and/or gloves used for such purposes. In particular, in some embodiments of the present disclosure, first and second images may be related in such a manner that the interplay between the two images provides enhanced entertainment.

The details of some example embodiments of the systems, methods, apparatuses, and devices of the present disclosure are set forth in the description below. Other features, objects, and advantages of the disclosure will be apparent to one of skill in the art upon examination of the present description, figures, examples, and claims. It is intended that all such additional systems, methods, apparatuses, features, and advantages be included within this description, be within the scope of the present disclosure, and be protected by one or more of the accompanying claims.

Figure 1:
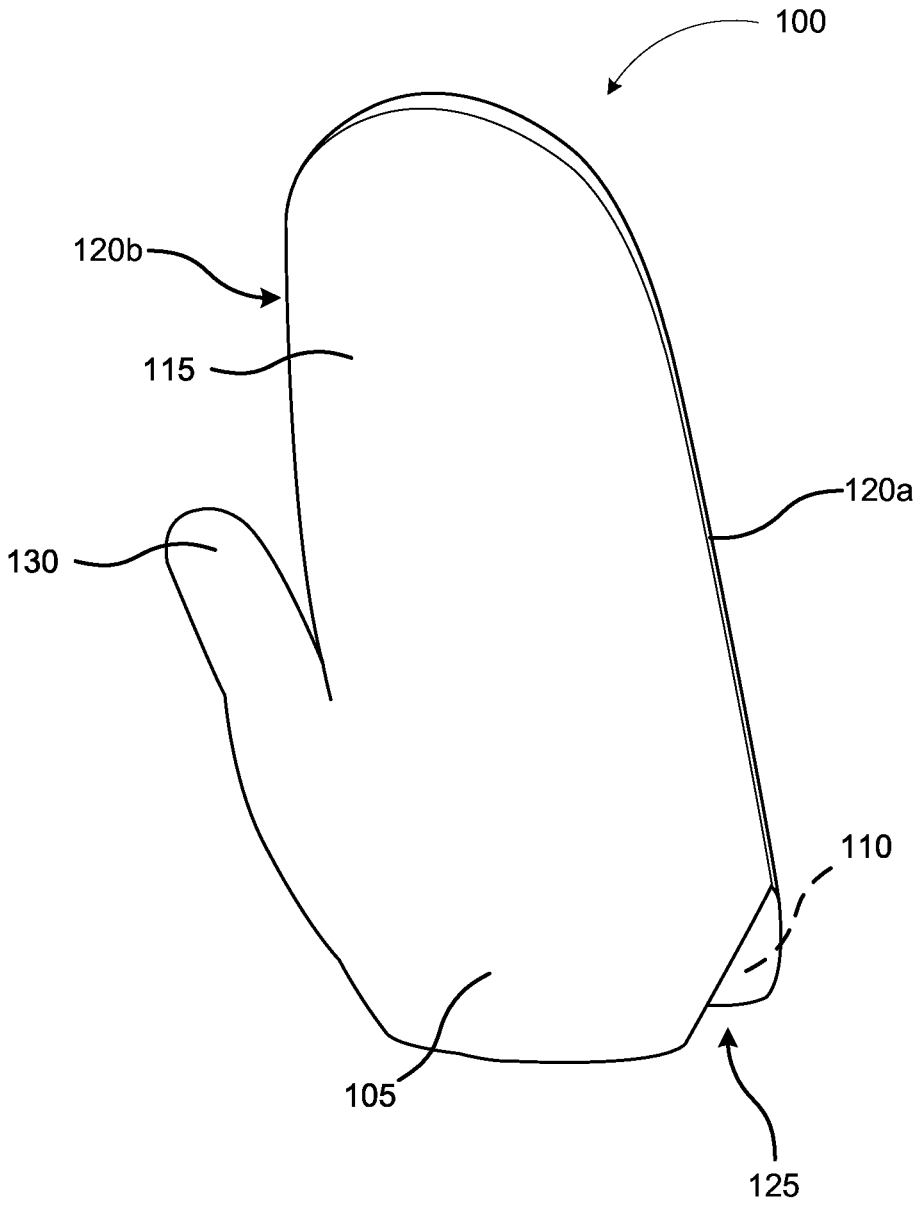
FIG. 1 illustrates a perspective view of an example glove in accordance with various embodiments of the present disclosure.

FIG. 1 illustrates a perspective view of an example embodiment of glove 100 that may be used to, by way of example, play games, in accordance with embodiments of the present disclosure. Typically, glove 100 is used in conjunction with another glove 100 to play games, present images to recipients, and the like. Before describing the interaction between multiple gloves 100, however, a description of glove 100 is provided with reference to FIG. 1, as follows.

As illustrated in FIG. 1, glove 100 includes first surface 110 and second surface 105. Glove 100 may be manufactured or otherwise created from any material (e.g., leather, plastic, polymer, silicone, rubber, various cloths, and the like). Glove 100 may take on various shapes, and in some instances may simply be a garment that covers the hand of a person wearing glove 100. In some cases, glove 100 may be novelty sized, or very large. For example, glove 100 may extend significantly beyond the wearer's fingers in terms of length, may be significantly wider than the wearer's hand, and so on. By having various sizes, glove 100 may be adapted to various games and versions of the games, and may accommodate different sized images and/or other features that may be included provided by glove 100, depending on what is desired for particular games and other entertainment.

With further reference to FIG. 1, first surface 110 generally corresponds to a back of a wearer's hand when the wearer's hand is placed in glove 100. For example, glove 100 as shown in FIG. 1 would correspond to the left hand of a wearer. In this example, with the wearer's left hand inserted into glove 100, first surface 110 would be generally proximal to the back of the wearer's left hand, including the back of the wearer's fingers on that hand. Conversely, second surface 105 generally corresponds to a palm of the wearer's hand when the wearer's hand is placed in glove 100. Again by way of example, with the wearer's left hand inserted into glove 100, second surface 105 would be generally proximal to the front of the wearer's left hand, including the palm-side of the wearer's fingers of that hand.

It should be noted that glove 100 in some instances fits snugly around the wearer's hand, such that the wearer may arrange glove 100 in various positions, move glove 100 into and between such positions, and so on, without glove 100 sliding off the wearer's hand. In other instances, glove 100 fits more loosely around the wearer's hand, for example, to enable glove 100 to be removed from the wearer's hand with relative ease, for comfort reasons, or the like. Nevertheless, whether glove 100 fits relatively snugly or loosely around the wearer's hand, first and second surfaces 110 and 105 may or may not be in full or partial contact with the wearer's hand.

In various embodiments, glove 100 also includes finger sheath 115, first side 120*a*, second side 120*b*, opening 125, and thumb sheath 130. One of skill in the art will appreciate upon studying the present disclosure that the wearer's hand may be inserted into glove 100 through opening 125 such that a thumb of the hand is inserted into and enclosed by thumb sheath 130 and fingers of the hand are inserted into and enclosed by finger sheath 115, while first and second sides 120*a*, 120*b* generally correspond to the sides of the wearer's hand. That is, in the example of FIG. 1, the portion of the wearer's left hand opposite the wearer's thumb and extending from the wearer's pinkie finger to the wearer's wrist would correspond to side 120*a*; and the portion of the left hand extending from the tip of the pointer finger down to the base of the thumb, over the thumb, and then down to the wrist would correspond to side 120*b*. First and second sides 120*a*, 120*b* may be used to enjoin first and second surfaces 105, 110 around a perimeter of first and second surfaces 105, 110.

In the situation in which the left hand is inserted into glove 100, and as described above, second surface 105 would correspond to a palm of the hand, and first surface 110 would correspond to a back of the hand. In such an instance, second surface 105 may at times be referred to as a palm-side surface of glove 100, and first surface 110 may at times be referred to as a back-hand surface of glove 100. With respect to opening 125, opening 125 may be circumferentially surrounded by a mechanism to allow an adjustable fitting of glove 100 on the wearer's hand. For example, glove 100 may include a Velcro strap surrounding opening 125 to adjust the size of opening 125 according to the wearer's hand or wrist size. Or, for example, glove 100 may include a tie, zipper, draw string, notched strap, elastic, or the like, that may be used to adjust the size and/or fit of glove 100 around the wearer's wrist.

In the example of FIG. 1, finger sheath 115 may contain a single cavity or open space therein, effectively created in one embodiment by joining of first surface 110 to second surface 105, for example along sides 120*a* and 120*b* (e.g., by stitching, gluing, bonding, taping etc.). In other embodiments, first and second surfaces 110, 105 are not joined because glove 100 is manufactured or created from a single piece of material. In any event, the single cavity in finger sheath 115 may be sized to accommodate four fingers of a wearer's hand, while the wearer's thumb may be placed in thumb sheath 130. In other examples, however, there may be sub-cavities in finger sheath 115, such that, although finger sheath 115 appears from the outside to contain only a single cavity, the sub-cavities may each accommodate one of the wearer's fingers. In other embodiments, various numbers of sub-cavities may be used in finger sheath 115 such that, for example, more than one of the wearer's fingers is encompassed in one or more of finger sheaths 115. In yet other embodiments of the disclosure, glove 100 may include multiple finger sheaths 115—e.g., such that each of the finger sheaths 115 encompasses less than four of the wearer's fingers. That is, glove 100 may resemble a five-fingered glove, or a glove with various numbers of fingers split into multiple finger sheaths 115. This may allow for flexibility in how the wearer may manipulate glove 100 for different games and entertainment purposes.

Figure 2A:
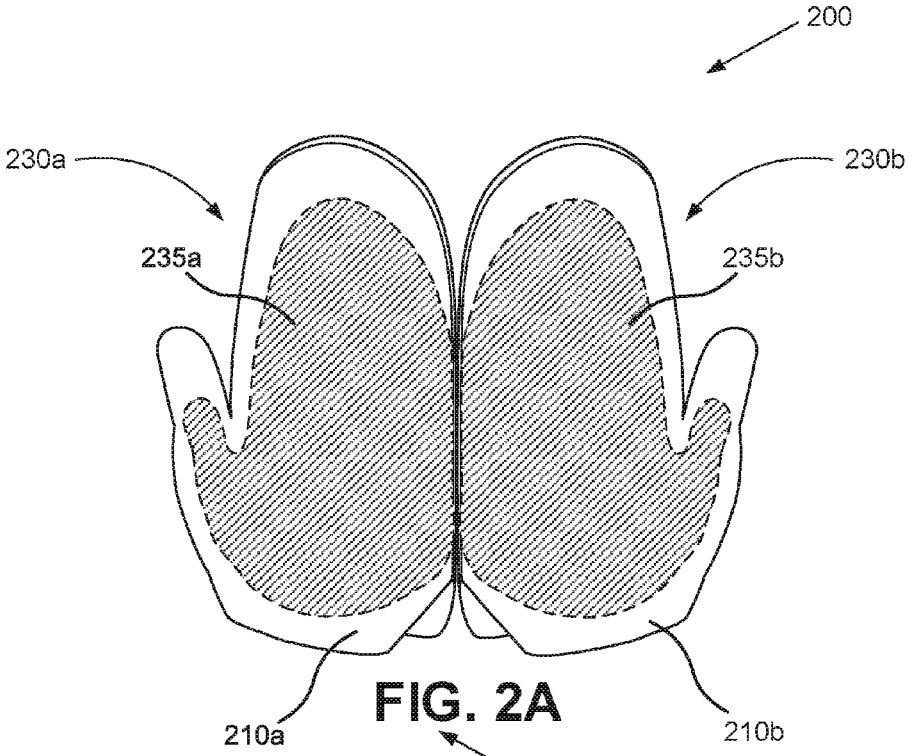
FIG. 2A illustrates a pair of example gloves in accordance with various embodiments of the present disclosure.
Figure 2B:
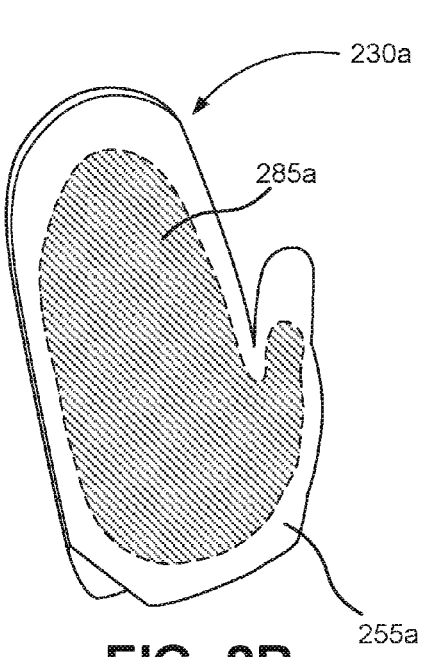
FIG. 2B illustrates a glove of a pair of example gloves in accordance with various embodiments of the present disclosure.
Figure 2C:
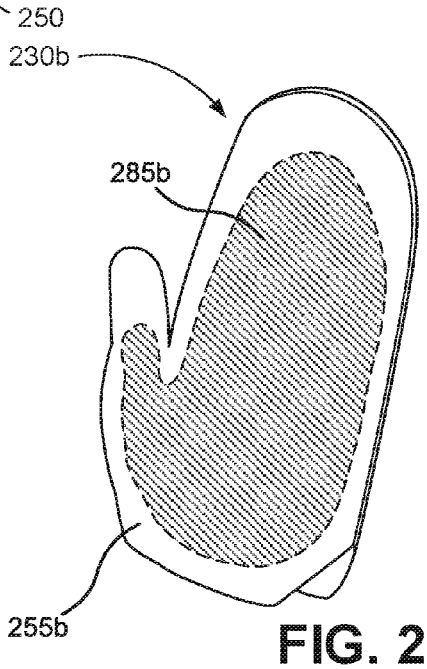
FIG. 2C illustrates a glove of a pair of example gloves in accordance with various embodiments of the present disclosure.

Having described some basic details of glove 100, the interaction between multiple gloves (e.g., glove 100) will now be described. FIGS. 2A, 2B, and 2C illustrate a pair of gloves, first and second gloves 230*a*, 230*b* (which may, e.g., be two instances of glove 100), in accordance with various embodiments of the present disclosure. Gloves 230*a*, 230*b* may be used for playing games, for example, by a wearer of gloves 230*a*, 230*b* (also referred to in instances as a user thereof) arranging gloves 230*a*, 230*b* in various positions to display various images to recipients. For example, in FIG. 2A, first and second gloves 230*a*, 230*b* are shown in first position 200. In FIGS. 2B and 2C, gloves 230*a*, 230*b* are shown in a second position 250. As will be described in further detail below, the displayed images may be created by the combination of partial images included on or being part of gloves 230*a*, 230*b*. Furthermore, gloves 230*a*, 230*b* may be arranged in various positions in sequence to create a series of full images from partial images, such that the series of full images may be used for playing games and for enhancing the entertainment value to a recipient interacting with the wearer.

Gloves 230*a*, 230*b* may contain any combination of the features described above in connection with glove 100. In one example, second glove 230*b* may be glove 100 or may be substantially similar thereto. Likewise, first glove 230*a* may be substantially similar to glove 100, but it will be appreciated by one of skill in the art that in the illustrated embodiment, gloves 230*a*, 230*b* are complementary to one another. That is, gloves 230*a*, 230*b* may be like mirror images, such that first glove 230*a* may accommodate a wearer's right hand while second glove 230*b* may accommodate the wearer's left hand. In other examples, however, gloves 230*a*, 230*b* may each be able to accommodate either the left or the right hand. For example, embodiments of glove 100, and in turn gloves 230*a*, 230*b*, may not include thumb sheath 130, and may instead include a single finger sheath 115 sized to accommodate the thumb as well as various fingers. In such examples, and as may be generally applicable to the entirety of the present disclosure (e.g., with respect to FIGS. 3A, 3B, 4A, 4B, and 5 and the associated descriptions of these Figures), two instances of the same glove—rather than mirror image gloves, for example—may be used to play the games or otherwise be used in connection with the present disclosure. This may be beneficial to reducing cost, by way of example.

In any event, as mentioned previously, each of gloves 230*a*, 230*b* may contain one or more of the elements described above with respect to glove 100. Though not each of these elements is explicitly labeled as such in FIGS. 2A, 2B, and 2C, one of skill in the art will appreciate how the numbered elements of FIG. 1 may be incorporated into FIGS. 2A, 2B, and 2C. As shown collectively in FIGS. 2A, 2B, and 2C, first glove 230*a* may include first surface 210*a* (FIG. 2A) and second surface 255*a* (FIG. 2B), and second glove 230*b* may include third surface 210*b* (FIG. 2A) and fourth surface 255*b* (FIG. 2C). In a fashion similar to that described above with regard to glove 100, first surface 210*a* generally corresponds to a back of a wearer's hand when the wearer's hand is placed in glove 230*a*. Likewise, second surface 255*a* generally corresponds to a palm of the wearer's right hand when the right hand is placed in glove 230*a*. In this regard, first surface 210*a* may be referred to at times as a back portion of first glove 230*a*, while second surface 255*a* may be referred to at times as a front portion of first glove 230*b*. Nevertheless, the front and/or back portions of first glove 230*a* are not necessarily limited to first and second surfaces 210*a*, 255*a*.

Additionally, with respect to second glove 230*b*, third surface 210*b* generally corresponds to a back of the wearer's left hand when the left hand is placed in glove 230*b*. Likewise, fourth surface 255*b* generally corresponds to a palm of the wearer's left hand when the left hand is placed in glove 230*b*. In this regard, third surface 210*b* may be referred to at times as a back portion of second glove 230*b*, while second surface 255*b* may be referred to at times as a back portion of second glove 230*b*. Nevertheless, the front and/or back portions of second glove 230*b* are not necessarily limited to third and surfaces 210*b*, 255*b*. Furthermore, with respect to the embodiments that utilize only a single glove 100 (that is, when glove 100 is may be used on either the left hand or the right hand, as described above), the front and back portions of glove 100 may be interchangeable. Namely, the front portion may serve equally well as the back portion, or vice versa, depending on the images that may be present on the front and back portions.

As shown collectively in FIGS. 2A, 2B, and 2C, first surface 210*a* includes first partial image 235*a*, and second surface 255*a* includes second partial image 285*a*. Likewise, third surface 210*b* includes third partial image 235*b*, and fourth surface 255*b* includes fourth partial image 285*b*. In FIG. 2A, first and third partial images are generally represented with hash marks of a first pattern and first shape, while in FIGS. 2B and 2C, second and fourth partial images are represented with hash marks of a second pattern and second shape. This is done for illustrative purposes only, and not to limit the relationship between any of the partial images disclosed herein, unless indicated otherwise herein. Nor are the shapes to be considered limiting, as the shapes of the partial images are provided for illustrative purposes only, unless indicated otherwise herein.

FIG. 2A illustrates that, when first and second gloves 230*a*, 230*b* are arranged in first position 200, first and third partial images 235*a*, 235*b* together form a first full image (not individually numbered in FIG. 2A). The first full image results from the combination of first and third partial images 235*a*, 235*b*. The first full image is described somewhat conceptually with respect to FIG. 2A, but is described in further detail with respect to FIG. 3A. When first and second gloves 230*a*, 230*b* are arranged in first position 200 and placed in front of the face of a wearer wearing gloves 230*a*, 230*b*, with second and fourth surfaces 255*a*, 255*b* facing toward the wearer's face (see, e.g., FIG. 4A, in which first and second gloves 430*a*, 430*b* are arranged in first position 400), the first full image faces outwardly from the wearer. In this manner, the first full image may be made viewable from one or more locations (e.g., by recipients interacting with the wearer as part of the game or entertainment). In other words, the first full image in this instance would be viewable from at least any number of locations having a line of sight to the first full image.

FIGS. 2B and 2C illustrate that, when first and second gloves 230*a*, 230*b* are arranged in second position 250, second and fourth partial images 285*a*, 285*b* together form a second full image (not individually numbered in FIGS. 2B and 2C). The second full image results from the combination of second and fourth partial images 285*a*, 285*b*. The second full image is described somewhat conceptually with respect to FIGS. 2B and 2C, but is described in further detail with respect to FIGS. 3B and 3C. When first and second gloves 230*a*, 230*b* are arranged in position 250 and placed at opposite sides of the wearer's head proximal the wearer's ears (see, e.g., FIG. 4B), the second full image faces in substantially the same direction as the wearer's face. In this manner, the second full image may be made viewable from the one or more locations. In other words, the second full image in this instance would be viewable from at least those locations having a line of sight to the second full image. The set of locations from which the first full image is viewable may be different from the set of locations from which the second full image is viewable. For example, in some games of peek-a-boo, the recipient of the first and second full images may move between the time the first image is presented and the second image is presented. In such example games, the wearer may move as well (e.g., in response to the recipient's movement), thus making the second full image viewable to the recipient notwithstanding that the recipient changed locations from the time the first full image was presented to the recipient.

Figure 3A:
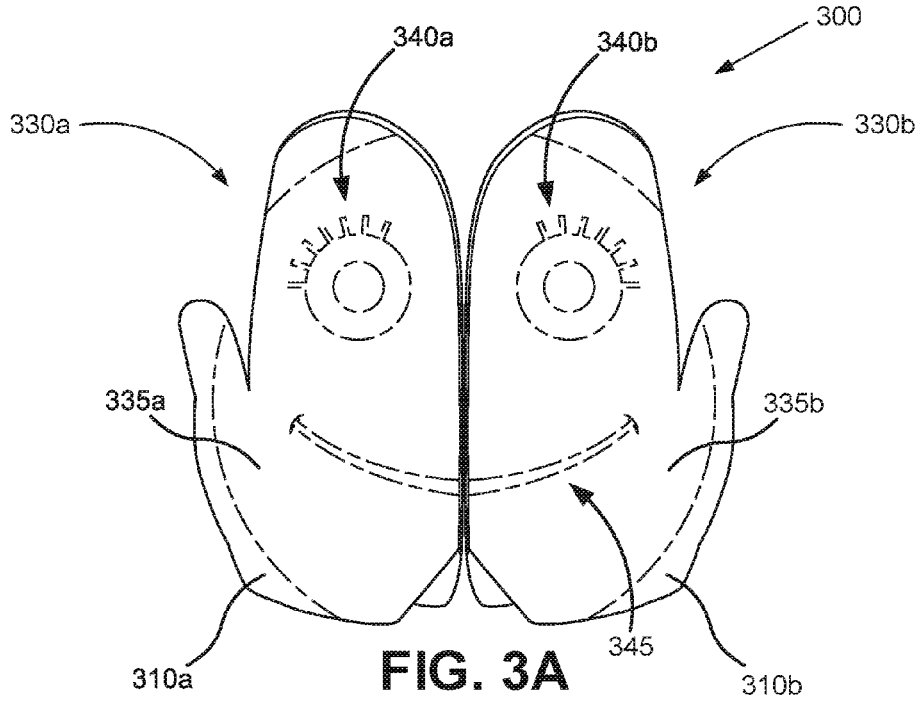
FIG. 3A illustrates another pair of example gloves in accordance with various embodiments of the present disclosure
Figure 3B:
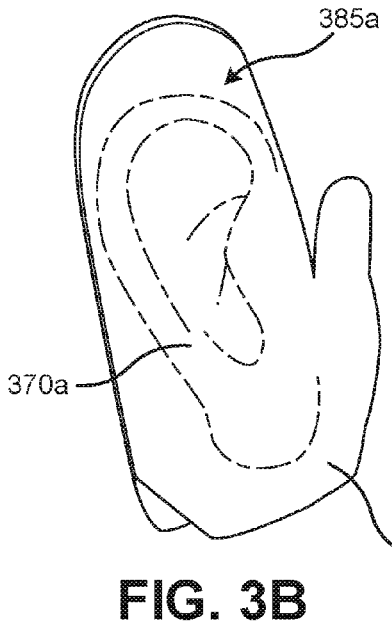
FIG. 3B illustrates another glove of a pair of example gloves in accordance with various embodiments of the present disclosure.
Figure 3C:
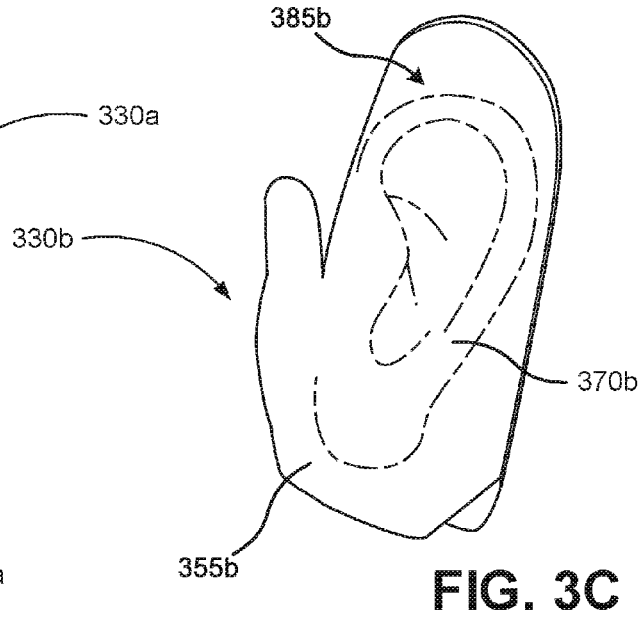
FIG. 3C illustrates another glove of a pair of example gloves in accordance with various embodiments of the present disclosure.

FIGS. 3A, 3B, and 3C illustrate a pair of gloves, first and second gloves 330*a*, 330*b* (e.g., a pair of two of glove 100), in accordance with various embodiments of the present disclosure. In FIG. 3A, first and second gloves 330*a*, 330*b* are shown in first position 300. In FIGS. 3B and 3C, gloves 330*a*, 330*b* are shown in a second position 350. The embodiments of FIGS. 3A, 3B, and 3C may be generally similar to those described with reference to FIGS. 2A, 2B, and 2C. FIGS. 3A, 3B, and 3C, however, present examples of specific full and partial images, for example, illustrating features that may be included in the full and/or partial images according to various embodiments of the disclosure. The features described with reference to FIGS. 3A, 3B, and 3C may be used to enhance games played and/or entertainment provided using gloves 330*a*, 330*b*. For example, gloves 330*a*, 330*b* may be arranged in various positions to present images having a variety of types of images with features that in some cases work together as a series of images is presented.

As shown in FIG. 3A, first glove 330*a* includes first surface 310*a*, which in turn includes first partial image 335*a*. Likewise, second glove 330*b* includes third surface 310*b*, which in turn includes third partial image 335*b*. In position 300, first and third partial images 335*a*, 335*b* form a first full image, which in this example, is shown as a smiley face. Other types of images, including, for example, different expressions on faces, objects other than faces, and so on, are contemplated in the present disclosure, and are described herein. In the illustrated example, the first full image includes feature 340, which is shown here as an eye. The first full image also includes common feature 345 extending across first and second gloves 330*a*, 330*b*. In this example, common feature 345 is a mouth. Accordingly, when gloves 330*a*, 330*b* are arranged in position 300, the first full image—a smiley face in this example—faces outwardly from the wearer's face (see, e.g., FIG. 4A), and is viewable from a location. With reference to FIGS. 3B and 3C, first glove 330*a* includes second surface 355*a*, which in turn includes second partial image 385*a*. Likewise, second glove 330*b* includes fourth surface 355*b*, which in turn includes fourth partial image 385*b*. In position 350, second and fourth partial images 385*a*, 385*b* form a second full image, which in this example is shown as a pair of ears. Other types of images, including, for example, different sizes and shapes of ears, horns, hairstyles, and the like, are contemplated as well in connection with the second full image.

As mentioned above, in various embodiments, the first and second full images include respective first and second sets of features. In one example implementation, this is accomplished by first and third partial images 335*a*, 335*b* including features (e.g., features 340*a*, 340*b*) of the first set of features, and second and fourth partial images 385*a*, 385*b* including features (e.g., features 370*a*, 370*b*) of the second set of features. In another example implementation, first and third partial images 335*a*, 335*b* include respective portions of common feature 345 of the first set of features. As shown in FIG. 3A, common feature 345 extends substantially continuously across first and second partial images 335*a*, 335*b*—i.e., substantially continuously across first and second gloves 330*a*, 330*b*. In this manner, common feature 345 may appear as a single feature in the first full image, even though common feature 345 is actually formed from separate features. The second set of features may likewise include a common feature (not shown in FIGS. 3B and 3C), where a portion of the common feature resides on second partial image 385*a* and fourth partial image 385*b*. In some examples, common feature 345 may be somewhat continuous in extending across first and second partial images 335*a*, 335, or may extend across in a discontinuous fashion.

In one particular instance of the present disclosure, each feature of the second set of features is different from the features in the first set of features. By way of example, the first set of features may include only a first type of or instance of features 340*a*, 340*b* (e.g., eyes), while the second set of features may include only a second type or instance of features 370*a*, 370 (e.g., ears). In this example, the first set of features 340*a*, 340*b* would not include any features in the second set of features 370*a*, 370*b*. As will be described further below, by including only different types of features, the first and second full images may be complementary to one another (though having different features is not necessary to achieve a complementary relationship between the images), which may be beneficial to the entertainment value of games that may be played using gloves 330*a*, 330*b*.

In the case in which the features are facial features, the facial features may be that of a person, an animal (e.g., an elephant, a walrus, a lion, a tiger, a bear, or any other animal), a creature (e.g., a dragon, alien, monster, vampire, a unicorn, etc.), a machine (e.g., a cyborg, a robot, and the like), and so on. Further, although the first and second sets of features shown in FIGS. 3A and 3B are facial features (e.g., eyes, ears, a mouth, etc.), any other types of features may be included in the first and second full images. The features may, by way of example, include words or text, people, logos, landscapes, shapes, and other designs, or the like, and may reside wholly on one of gloves 330*a*, 330*b*, or be common to and extend across both.

Figure 4A:
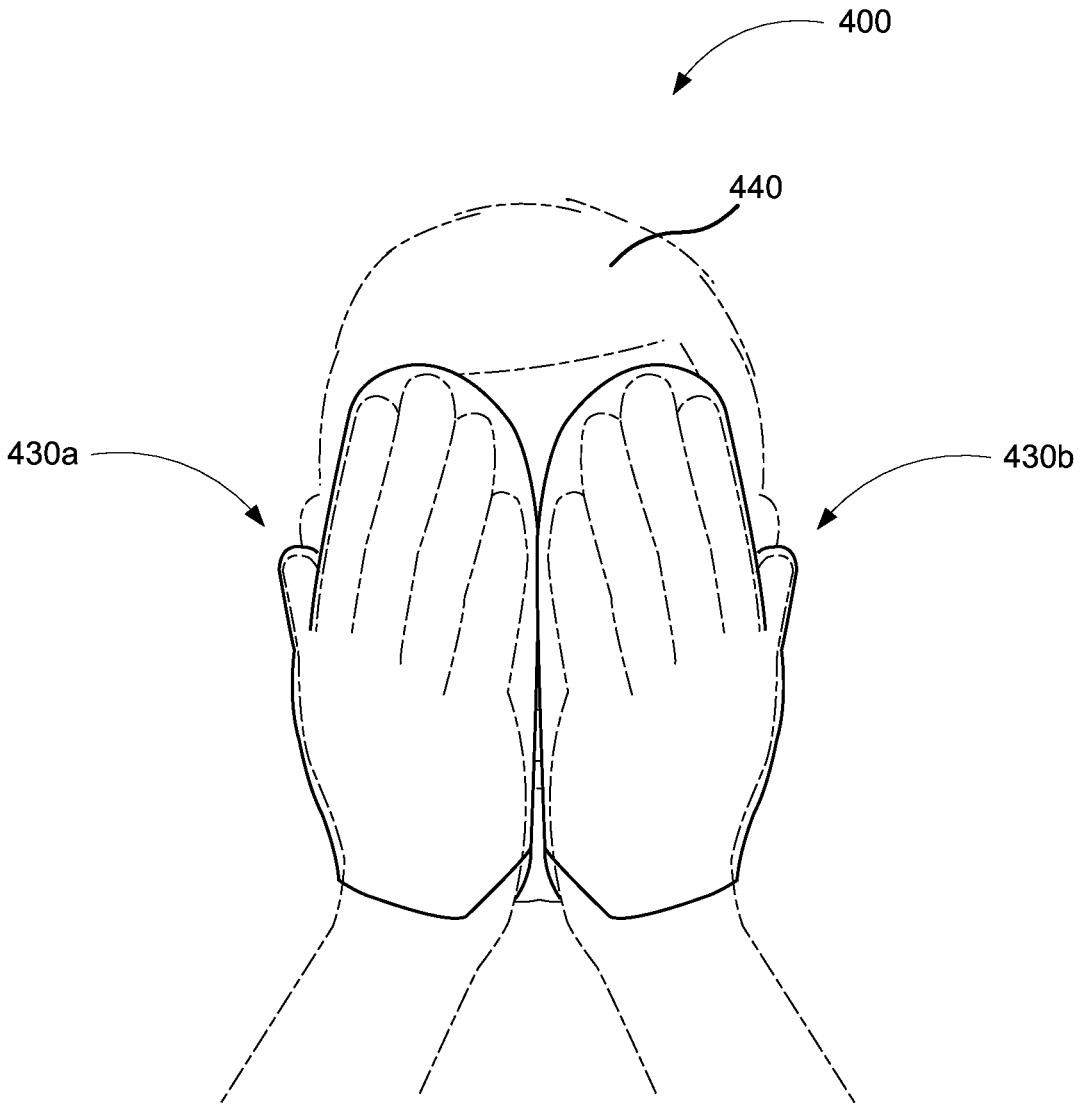
FIG. 4A illustrates a pair of example gloves on a wearer in accordance with various embodiments of the present disclosure.
Figure 4B:
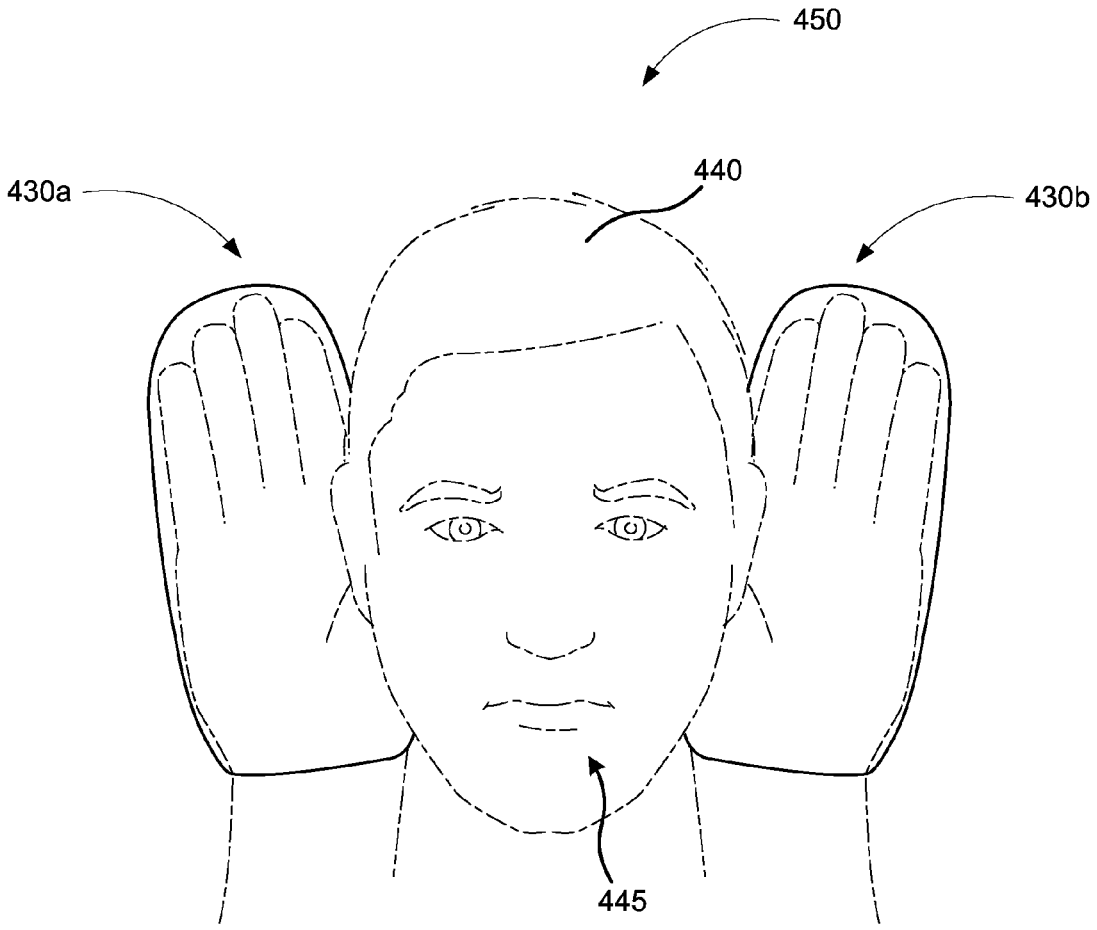
FIG. 4B illustrates a pair of example gloves on a wearer in accordance with various embodiments of the present disclosure.

FIGS. 4A and 4B illustrate an example pair of gloves (which, e.g., may be similar to the various gloves disclosed hereinabove) that may be used by wearer 440, in accordance with various embodiments of the present disclosure. FIG. 4A depicts wearer 440 with wearer 440's hands inserted respectively into first and second gloves 430*a*, 430*b* in first position 400 in front wearer 440's face. In position 400, the back portion of first and second gloves 430*a*, 430*b* faces outwardly from wearer 440's face. Accordingly, in the examples described above in which back portions of the first and second gloves (e.g., first and second gloves 430*a*, 430*b*) face outwardly from a wearer (e.g., wearer 440), a full image included on the combined back portions of gloves 430*a*, 430*b* would also face outwardly from wearer 440's face and be visible from a first location (e.g., by a recipient of the game or entertainment played or presented using the gloves).

FIG. 4B depicts wearer 440 with first and second gloves 430*a*, 430*b* in second position 450, with gloves 430*a*, 430*b* at substantially opposite sides of wearer 440's head and proximal to wearer 440's ears. In the illustrated example, in position 450, the front portions of first and second gloves 430*a*, 430*b* face in substantially the same direction as wearer 440's face 445, such that a second full image on the front portions of the gloves disclosed herein (e.g., gloves 430*a*, 430*b*) would be visible from a second location. As mentioned above, the first and second location may be the same location but may also be different locations.

Figure 5:
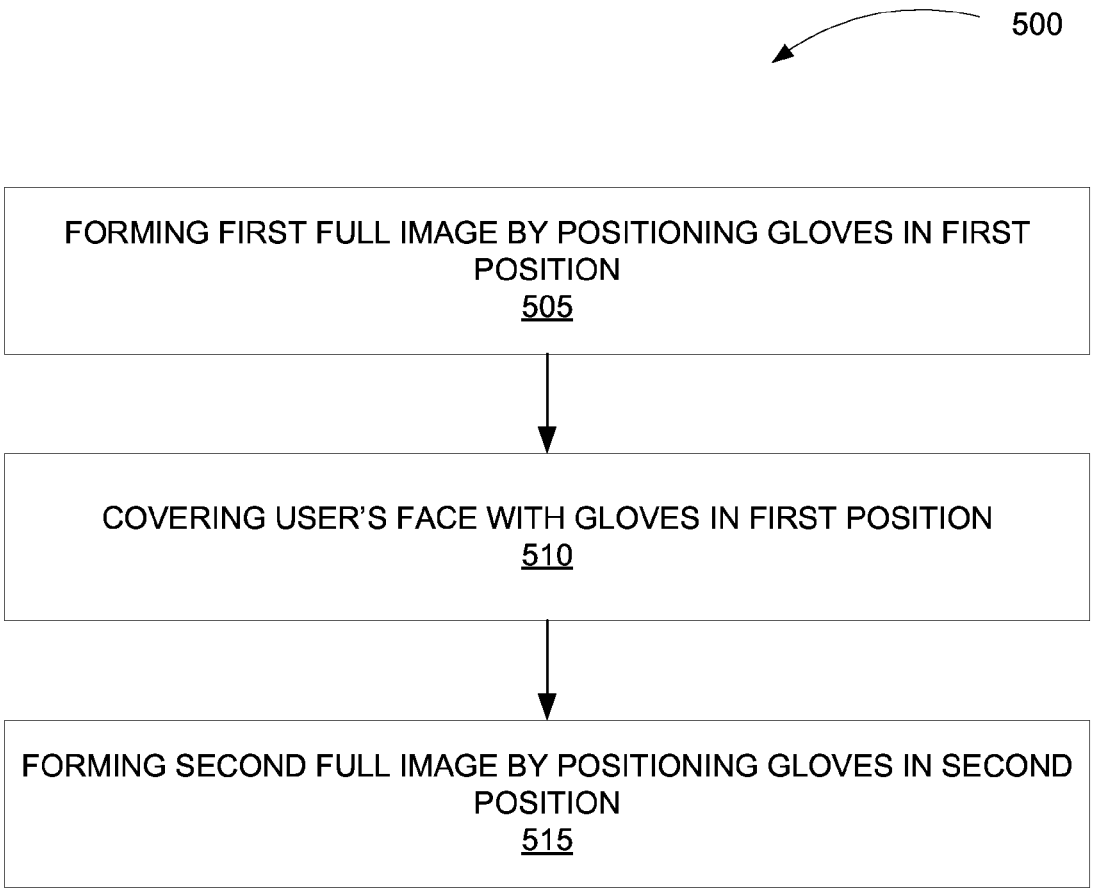
FIG. 5 is an operational flow diagram illustrating an example method for playing a game in accordance with various embodiments of the present disclosure.

FIG. 5 is an operational flow diagram illustrating example method 500 of playing a game (e.g., peek-a-boo, or the like) with first and second gloves. The operations of method 500 may be carried out, in some embodiments, by one or more of the components/elements shown in FIGS. 1, 2A, 2B, 3A, 3B, 4A, and 4B, and described above with reference to these Figures. For example, method 500 provides a series of operations that, in some instances, may be performed using the above-described gloves (e.g., glove 100, gloves 230*a*, 230*b*, gloves 330*a*, 330*b*, and/or gloves 430*a*, 430*b*) and any of the respective elements, sub-elements, features, and aspects, of those gloves.

In this regard, in some embodiments of method 500, the first glove is substantially similar to, or may indeed be, glove 100 or first glove 230*a*, 330*a*, or 430*a*. Likewise, the second glove may be substantially similar to, or may indeed be, glove 100 or second glove 230*b*, 330*b*, or 430*b*. The first glove includes a palm-side surface that corresponds to a palm of a first hand (e.g., a wearer's right hand), and a back-hand surface that corresponds to a back of the first hand; and the second glove includes a palm-side surface that corresponds to a palm of the second hand (e.g., the wearer's left hand), and a back-hand surface that corresponds to a back of the first hand. The respective palm-side surfaces of the first and second gloves may, in some instances, be substantially similar to second surfaces 105, 255*a*, and/or 355*a*. Likewise, in some instances, the back-hand surface may be substantially similar to first surfaces 110, 210*a*, and/or 310*a*.

Generally, the operations of method 500 may be used to provide enhanced entertainment and/or game playing using various of the gloves disclosed herein. For example, the operations of method 500 may generally include covering and subsequently revealing the wearer's face and through these operations forming images and displaying the images to recipients. The images combined with sequences of revealing and covering the wearer's face may capture the recipient's attention more than similar games played without using the gloves disclosed herein. Additional advantages of method 500 will be appreciated in light of the following description.

At operation 505, method 500 includes forming a first full image by positioning the first and second gloves in a first position (see, e.g., first positions 200, and/or 300). The first full image includes a first partial image on the back-hand surface of the first glove and a third partial image on the back-hand surface of the second glove. The first and third partial images, in some embodiments, may be substantially similar to first and third partial images 235*a*, 235*b*, 335*a*, and/or 335*b*. The first full image may be formed with the first and second gloves in a variety of locations. For example, and as shown in FIG. 4A, in one embodiment, the first full image may be formed by placing first and second gloves in first position 400. In some instances, placing the gloves in the first position involves abutting a finger sheath (e.g., finger sheath 115 in FIG. 1) of the first glove to a finger sheath of the second glove. With the finger sheaths abutted to one another in position 400, the portions of the gloves respectively corresponding to, e.g., side 120*a* in FIG. 1 are brought into contact, or are at least positioned proximal one another. It should be noted that although FIG. 4A has been used for reference here, operation 510 does not necessarily require that the gloves cover the wearer's face in the first position. Rather, first and second gloves may be placed at various locations relative to the wearer.

At operation 510, method 500 further includes covering a wearer's face while the first and second gloves are arranged in the first position. FIG. 4A depicts an example of how operation 510 may be carried out. As shown, first and second gloves 430*a*, 430*b* are substantially covering wearer 440's face while gloves 430*a*, 430*b* are arranged in first position 400. Per operation 510, while the wearer's face is substantially covered with the first and second gloves, the first full image faces outwardly from the wearer's face, and the palm-side portions of the first and second gloves are proximal the wearer's face. With reference to FIG. 3A, for example, in one embodiment of operation 510, the first full image (e.g., a smiley face) is made up of first and second partial images 355*a* and 355*b*, and faces outwardly from first and third surfaces 310*a*, 310*b*.

In instances of the disclosure, first and second gloves 430*a*, 430*b* may be first and second gloves 330*a*, 330*b*, respectively. In such instances, in first position 400 shown in FIG. 4A, the first full image (e.g., a smiley face) faces outwardly from wearer 440's face. In such instances and in a similar vein, as shown in FIG. 4A, in position 400, the palm-side portions of gloves 430*a*, 430*b* are proximal wearer 440's face relative to the back-hand portions of gloves 430*a*, 430*b*. In position 400, and also at operation 510, the palm-side portions of the first and second gloves (e.g., gloves 430*a*, 430*b*, etc.), may actually be touching wearer 440's face, or may simply be closer to wearer 440's face than the back-side portions of the gloves. In either case, the gloves may substantially cover the wearer's face relative to a viewer or recipient of the game looking toward wearer 440's face.

Referring again to FIG. 5, at operation 515, method 500 includes forming a second full image by positioning the first and second gloves in a second position. In the second position, the second full image faces outwardly from the wearer's face. The second full image includes a second partial image on the palm-side surface of the first glove and a fourth partial image on the palm-side surface of the second glove. The second and fourth partial images, in some embodiments, may be substantially similar to second and fourth partial images 285*a*, 285*b*, 385*a*, and/or 385*b*. In one embodiment of method 500, the first full image includes a set of primary features, and the second full image includes a set of secondary features not included in the set of primary features. The primary and secondary images may be complementary to one another, for example, to enhance the entertainment level provided by the game being played.

FIG. 4B depicts an example of how operation 515 may be carried out in various embodiments. As shown, first and second gloves 430*a*, 430*b* in this example are placed with the palm-side portions thereof facing outwardly from wearer 440's face when gloves 430*a*, 430*b* are arranged in second position 450. With reference back to FIGS. 3B and 3C, for example, the second full image (e.g., a pair of left and right ears) is made up of second and fourth partial images 385*a* and 385*b*, and faces outwardly from second and fourth surfaces 355*a*, 355*b*. As mentioned previously, in instances of the disclosure, first and second gloves 430*a*, 430*b* may be first and second gloves 330*a*, 330*b*, respectively. In such instances, in second position 400 shown in FIG. 4B, the second full image (e.g., a pair of ears) faces outwardly from wearer 440's face. In position 450, and also at operation 515, the palm-side portions of the first and second gloves (e.g., gloves 430*a*, 430*b*, etc.), may actually be touching wearer 440's face or head, or may simply be proximal wearer 440's face (e.g., within a few inches). In other instances, at operation 515, the first and second gloves may be placed in various positions, including farther away from the wearer's head (e.g., more than a few inches away), so long as the second full image generally faces outwardly from the wearer's face (e.g., toward a recipient of the game). In one example of method 500, forming the second full image at operation 515 includes revealing the wearer's face (compare, e.g., FIG. 4A to FIG. 4B).

In the above-described manner, operations 505, 510, and 515 may be utilized to play the game of peek-a-boo but in an enhanced fashion due to the forming and displaying of the first and second full images. Particular, in some embodiments of method 500, the first and second full images may be complementary to one another. For example and as mentioned, the first full image may include a set of primary features, and the second full image may include a set of secondary features not included in the primary features. An example of this is shown in FIGS. 3A, 3B, and 3C, in which the first full image is a smiley face made up of features including eyes and a mouth, and the second full image is made up of the features of ears. While the ears may correspond to the smiley face—e.g., the appearance of the ears is such that the ears could be part of the smiley face—the ears are not included in the first full image. In this manner, the first full image and the second full image are complementary due to the complementary nature of the respective features of these images. In particular, in the first position, the ears are generally hidden from view while the smiley face is viewable to a recipient or on-looker. When the gloves are arranged in the second position, however, the smiley face is no longer visible. Instead of displaying the smiley face to the recipient, the ears corresponding to the smiley face are displayed. The complementary nature of the first and second full images, and in particular examples the complementary nature of the primary and secondary features, may increase the entertainment level of a typical game of peek-a-boo.

As discussed above with reference to FIGS. 3A, 3B and 3C, the primary and secondary features included respectively in the first and second full images may be facial features, but may also be other features in various examples. In the examples in which the features are facial features, however, the features may be those of a human, animal, etc. Such features may further enhance the game of peek-a-boo when the features are complementary as between the first and second positions, as follows. The wearer's face will generally include characteristics, such as, by way of example, the shape and size of the wearer's nose, eyes, and mouth, facial hair or in some cases a lack thereof, scars, moles, and so on. In some examples of the present disclosure, the primary features included in the first full image may resemble the characteristics of the wearer's face but may be used to enhance these characteristics. For example, the wearer may not have a moustache, but the primary features may include a moustache. Likewise with the secondary features. For example, the wearer may have small ears or ears typically covered by the wearer's hair, but the secondary features may include large ears. In this manner, the primary features may enhance some aspects of the wearer's facial characteristics, while the secondary features may enhance other aspects of the wearer's facial characteristics.

In other instances, the primary features include animal or otherwise cartoonish features, having various colors, bold lines, patterns, and/or the like. In these instances, the secondary features may contain similar colors, use of bold lines, patterns, etc., such that changing from the first position to the second position results in a dramatic visual change (e.g., between an elephant's face in the first position and the wearer's face in the second position) while maintaining some continuity between the primary and secondary features (e.g., because the elephant ears, along with the associated colors etc. are included in the second full image). In this manner, these and the other above-described features more effectively capture the attention of the recipient while also providing for an increased level of entertainment.

The presence of broadening words and phrases such as "one or more," "at least," "but not limited to" or other like phrases in some instances herein will not be read to mean that the narrower case is intended or required in instances where such broadening phrases may be absent. Additionally, the various embodiments set forth herein are described in terms of example block diagrams, flow charts and other illustrations. As will become apparent to one of ordinary skill in the art after reading this document, the illustrated embodiments and their various alternatives can be implemented without confinement to the illustrated examples. For example, block diagrams and their accompanying descriptions should not be construed as mandating a particular architecture or configuration.

While various embodiments of the present disclosure have been described above, it should be understood that they have been presented by way of example only, and not of limitation. Likewise, the various diagrams may depict an example architectural or other configuration for the disclosure, which is done to aid in understanding the features and functionality that can be included in the disclosure. The disclosure is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present disclosure. Additionally, with regard to flow diagrams, operational descriptions and method claims, the order in which the steps are presented herein shall not mandate that various embodiments be implemented to perform the recited functionality in the same order unless the context dictates otherwise.

Although the disclosure is described above in terms of various example embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosure, whether or not such embodiments are described and whether or not such features are presented as being a part of a described embodiment. Thus, the breadth and scope of the present disclosure should not be limited by any of the above-described example embodiments.

What is claimed is:

1. A method of playing a game of peek-a-boo with first and second gloves, the first glove comprising a palm-side surface that corresponds to a palm of a first hand and a back-hand surface that corresponds to a back of the first hand, the second glove comprising a palm-side surface that corresponds to a palm of a second hand and a back-hand surface that corresponds to a back of the second hand, the method comprising:

forming a first full image by positioning the first and second gloves in a first position, the first full image comprising a first partial image on the back-hand surface of the first glove and a third partial image on the back-hand surface of the second glove;

substantially covering a wearer's face while the first and second gloves are arranged in the first position, such that the first full image faces outwardly from the wearer's face and the palm-side surfaces of the first and second gloves are proximal the wearer's face relative to the back-hand surfaces of the first and second gloves; and forming a second full image by positioning the first and second gloves in a second position such that the second full image faces outwardly from the wearer's face, the second full image comprising a second partial image on the palm-side surface of the first glove and a fourth partial image on the palm-side surface of the second glove;

wherein the first full image comprises a set of primary features, wherein the second full image comprises a set of secondary features, wherein the primary and secondary features comprise facial features selected from an image of a face, wherein the primary features are selected from the group consisting of eyes, a nose, and a mouth;

wherein the secondary features consist essentially of two ears;

wherein the primary and secondary features are complementary to one another in that the primary features differ from the secondary features but the secondary features visually correspond to the primary features by virtue of both the primary and secondary features being selected from the image of the face.

2. The method of claim 1, wherein forming the second full image comprises revealing the wearer's face.

3. The method of claim 1, wherein the set of secondary features is not included in the set of primary features.

4. The method of claim 1, wherein the primary and secondary features are facial features of an elephant.

5. The method of claim 3, wherein at least one of the primary features and secondary features are used to enhance characteristics of the wearer's face by differing from a corresponding feature of the wearer's face.

* * * * *